US007104427B2

(12) United States Patent
Pericard et al.

(10) Patent No.: US 7,104,427 B2
(45) Date of Patent: Sep. 12, 2006

(54) GAPLESS AEROSOL VALVE ACTUATOR

(75) Inventors: Louis Pericard, Hattersheim (DE); Gunter Kolanus, Niedernhausen (DE)

(73) Assignee: Precision Valve Corporation, Yonkers, NY (US)

( * ) Notice: Subject to any disclaimer, the term of this patent is extended or adjusted under 35 U.S.C. 154(b) by 21 days.

(21) Appl. No.: 10/348,098

(22) Filed: Jan. 21, 2003

(65) Prior Publication Data

US 2004/0140328 A1 Jul. 22, 2004

(51) Int. Cl.
*B65D 83/00* (2006.01)

(52) U.S. Cl. ..... 222/402.13; 222/402.11; 222/153.11; 222/182

(58) Field of Classification Search ..... 222/402.1, 222/402.11, 402.13, 402.15, 402.22, 153.1, 222/153.11, 182, 394, 321.8
See application file for complete search history.

(56) References Cited

U.S. PATENT DOCUMENTS 3,348,740 A * 10/1967 O'Donnell ..... 222/153.06
3,828,982 A * 8/1974 Steigerwald ..... 222/153.11
3,918,615 A * 11/1975 Morane ..... 222/402.13
4,095,725 A * 6/1978 Goncalves ..... 222/153.06
4,620,646 A * 11/1986 Crapser ..... 222/153.11
5,027,982 A * 7/1991 Demarest ..... 222/182
5,255,823 A * 10/1993 Tichy et al. ..... 222/153.14
6,006,957 A * 12/1999 Kunesh ..... 222/402.13
6,302,302 B1 * 10/2001 Albisetti ..... 222/153.11
6,318,595 B1 * 11/2001 Walters ..... 222/1
6,510,967 B1 * 1/2003 DeSimone ..... 222/402.1

* cited by examiner

*Primary Examiner*—Frederick Nicolas
(74) *Attorney, Agent, or Firm*—Kilgannon & Steidl

(57) ABSTRACT

An aerosol valve actuator with a discrete shell-like enclosure and a discrete, bottom mounted, actuating member with finger actuating pad. An opening with a perimeter, in the upper portion of the enclosure, is closed in non-actuated position by the finger pad which has a greater perimeter than the opening perimeter. The finger pad has an upper surface with a portion adjacent its perimeter which underlies and contacts the enclosure upper portion directly adjacent its opening leaving no discernable gap. The finger pad cannot be pushed upwardly through the opening to create a "smiling" effect. The actuating member is connected to the enclosure interior side wall, and has a nozzle outer end snap fit and extending into and filling an enclosure side wall product dispensing opening to prevent spray noise entering the enclosure and being intensified.

5 Claims, 6 Drawing Sheets

GAPLESS AEROSOL VALVE ACTUATOR

FIELD OF THE INVENTION

The present invention relates to aerosol valve actuators of the enclosure or spray dome type. Such actuators generally have a shell-like member mounted onto the pressurized product container and/or over the mounting cup of the aerosol valve on the container, and a finger actuatable means associated with the shell-like enclosure and operatively connected to the aerosol valve stem for actuating the aerosol valve and dispensing the product.

BACKGROUND OF THE INVENTION

In many prior art aerosol valve actuators of the nature referred to above, the finger actuatable means is a finger pad that is integrally molded as one piece with the shell-like enclosure and extends into an opening in the upper portion of the shell-like enclosure. The finger pad has an integral hinge molded to the shell-like enclosure. Inherent in the one-piece molding process is the fact that a resultant visible gap exists between the outer periphery of the finger pad and the periphery of the hole in the upper portion of the enclosure. Further, when one-piece prior art actuators of this type are assembled onto the aerosol valve, the finger pad in certain instances may be pushed by the valve stem above its normal non-operating position to a higher than desired position above the top wall opening, leaving a large separation or gap (sometimes referred as a "smiling" appearance) between the bottom of a portion of the finger pad opposite the hinge and the surrounding shell-like enclosure. The customer and consumer when first encountering such an aerosol actuator may find the above-referenced gaps as aesthetically unappealing, and in the latter instance as indicating some defect in the product.

In other prior art aerosol valve actuators of the above general type, the finger pad is molded as a separate member from the shell-like enclosure and is snap fitted into the shell-like enclosure. In such known prior art actuators, however, there still remains a visible gap between the substantially vertical outer sides of the finger pad and the perimeter of the hole in the upper portion of the shell-like enclosure. Further, when such two-piece prior art actuators of this type are assembled onto the aerosol valve, the finger pad in certain instances is still subject to being pushed by the valve stem above its normal non-operating position to a still higher position above the top wall opening, again leaving the aforesaid large "smiling" gap as in the above-referenced one-piece actuators. The problem of visually unappealing gaps or perceived defects remains for the customer and consumer. Additionally, in such actuators, the snap fit connection is not always sufficient to maintain the two pieces of the actuator assembled during shipping, and feeding and assembly of the actuator to the aerosol container, etc.

Still further prior art aerosol valve actuators of the above general type have protruding surfaces positioned below the top of the finger pads or actuating buttons to prevent the finger pad or button being pushed through the opening in the upper portion of the enclosure upon assembly onto the valve. The buttons/pads of such prior art actuators still have substantially vertical sides at the elevation where the buttons/pads pass through the opening, accordingly still show an aesthetically unappealing gap between the vertical sides of the button or pad and the enclosure opening, and thus do not provide the appearance of a smooth surface continuation between the perimeter of the opening in the upper portion of the enclosure and the radially inward upper surface of the finger pad or button immediately adjacent the opening perimeter.

Additionally, there can be a problem of excessive spray noise in enclosure or spray dome type actuators. In such actuators where the spray nozzle is inside the enclosure, sprays through a hole in the side wall of the enclosure, and terminates even slightly short of the side wall, the enclosure mounted on the container can act as a resonant sound chamber and greatly amplify the sound of the spray noise.

SUMMARY OF THE INVENTION

The present invention is intended to provide a gapless, at least two piece, aerosol valve actuator which is strongly constructed, easily manufactured and assembled, functions reliably and efficiently, does not create excessive spray noise, and is aesthetically appealing in its assembled condition. In particular, in the assembled and non-operative condition, the finger pad actuating member leaves no discernable gap between the perimeter of the opening in the upper portion of the shell-like enclosure and the immediately adjacent finger pad upper surface radially inward of the opening perimeter toward the actuator central axis. Further, by virtue of its design configuration, the finger pad actuating member cannot be pushed through the opening upon assembly of the actuator onto the valve stem.

The aerosol valve actuator includes a first shell-like member and a second actuating member, the two members being discrete and distinct from one another rather than being integrally molded as one piece. The first shell-like member has a side wall with exterior and interior wall surfaces, an open bottom for mounting to an aerosol container (either by being directly snapped onto the pressurized container and/or by being snapped over the aerosol valve mounting cup mounted on top of the aerosol container), and an upper portion having an opening therein with defining perimeter. The second, actuating, member is inserted into the bottom opening of the first shell-like member and is connected to the first shell-like member, for example by being snap fit or friction fit upon assembly to the inner side wall of the first shell-like member. The second actuator member has a finger actuating pad biased to an upper position when not actuated, a depending tube from the finger actuating pad for connection to an aerosol valve stem, and an outlet tube in fluid connection with the depending tube and having an outlet nozzle within which a conventional nozzle insert may be provided as desired. The outer end of the outlet nozzle is snap fit and extends into a product dispensing opening in the side wall of the container, firstly to assure maintaining the assembly during shipping and feeding of the actuator, and secondly to lessen spray noise upon actuation since the spray noise can not enter back into the first shell-like member to create a resonant amplification thereof.

Upon assembly, the finger actuating pad in its non-actuated position extends completely across the opening in the upper portion of the first shell-like member, and has an outer perimeter greater than said opening perimeter. The finger actuating pad has an upper surface including a portion adjacent the pad perimeter which, when the finger pad is in its non-actuated upper position to which it is biased, underlies and contacts the underside of the upper portion of the first shell-like member directly adjacent the upper portion opening. The finger pad cannot be pushed upwardly through the upper opening to leave a large gap (the "smiling" effect) indicating a possible assembly defect, and there is no visible gap in the non-actuated position between the perimeter of the upper portion opening in the first member and the directly adjacent radially inward (toward the actuator central axis) visible finger pad upper surface.

Other features and advantages of the present invention will be apparent from the following description, drawings and claims.

DETAILED DESCRIPTION OF EMBODIMENT

Figure 1:
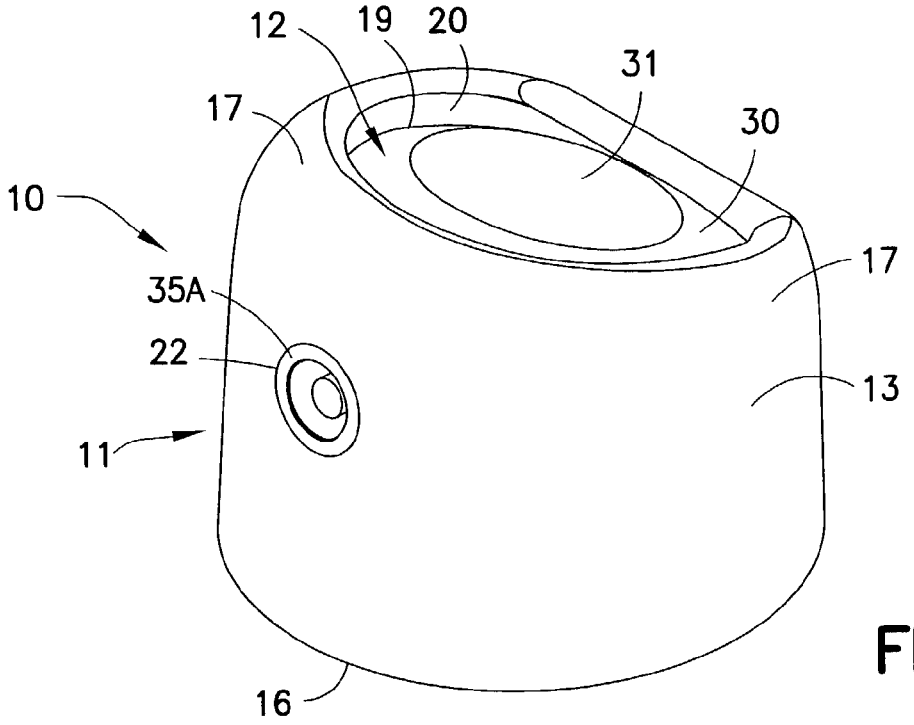
FIG. 1 is a perspective view from the right front of the assembled gapless aerosol valve actuator of the present invention.
Figure 2:
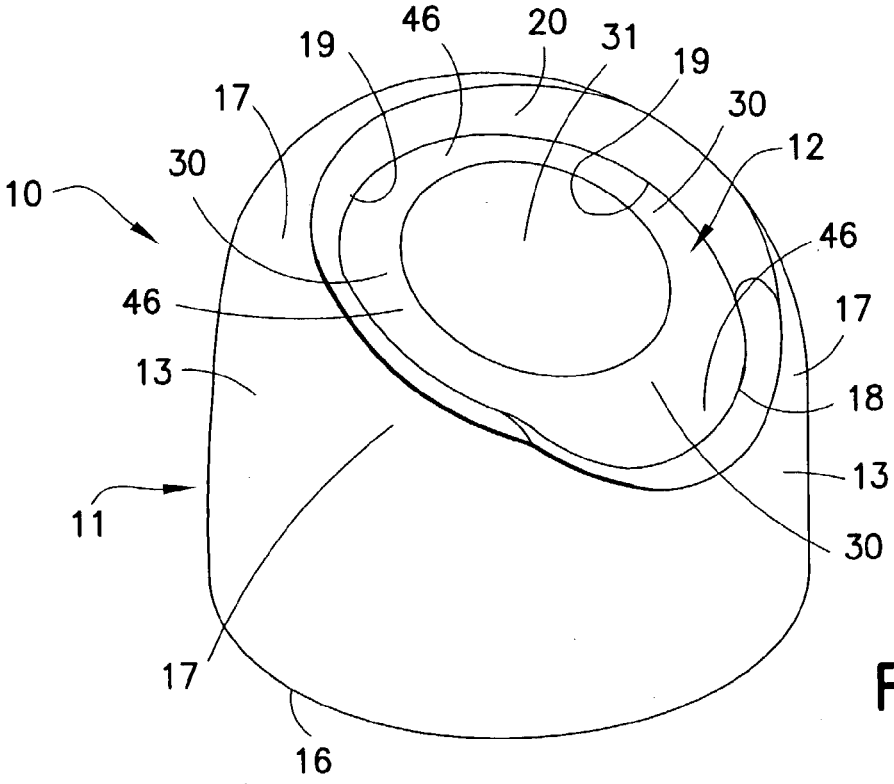
FIG. 2 is a perspective view from the left rear of the assembled gapless aerosol valve actuator of the present invention.
Figure 3:
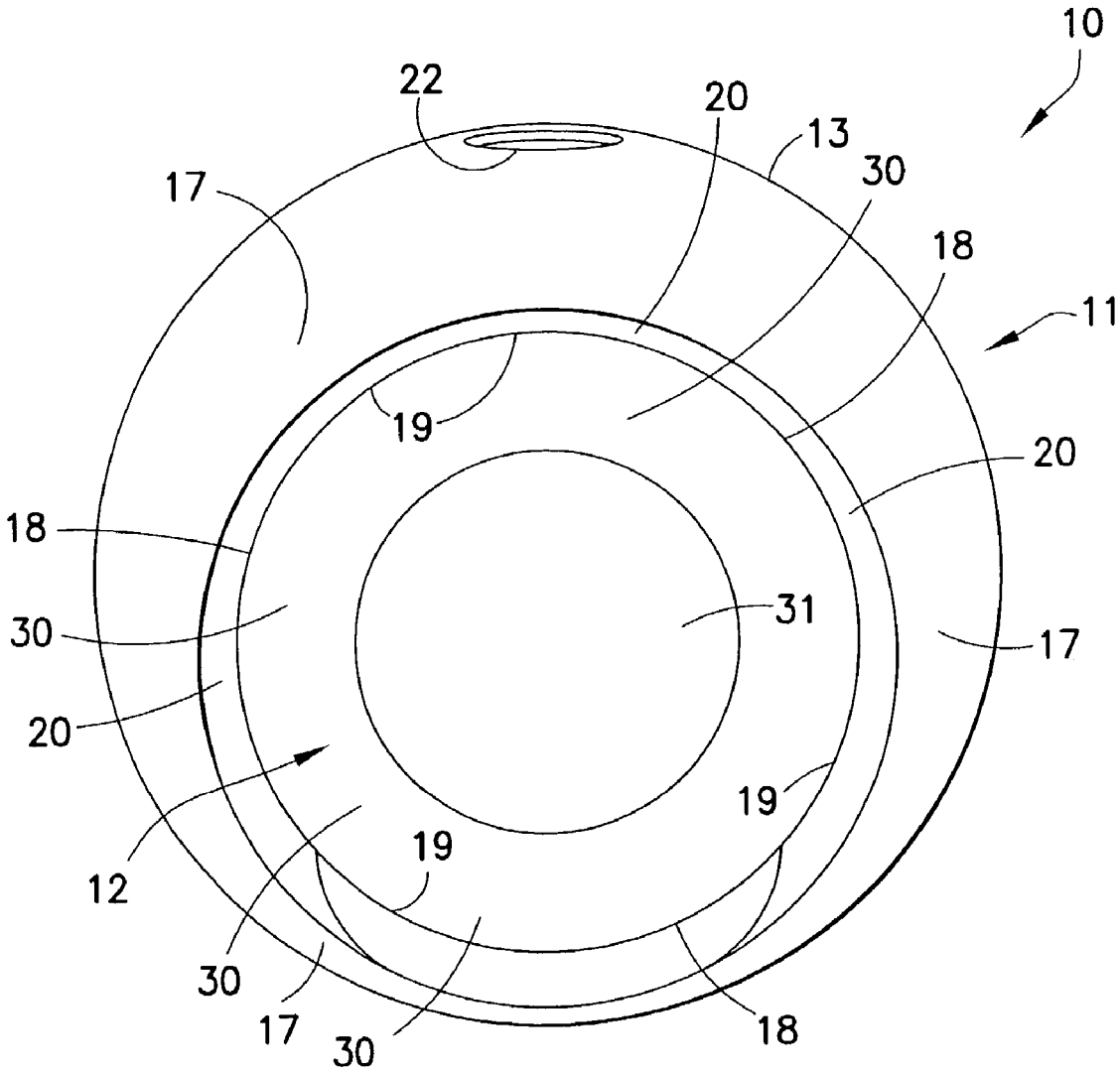
FIG. 3 is a top plan view of the assembled gapless aerosol valve actuator of the present invention.

Referring to FIGS. 1–3, aerosol valve actuator 10 of the present invention is shown assembled from two discrete, separately molded, plastic members 11 and 12. In known fashion, the actuator 10 is for mounting on an aerosol container (not shown) which may contain a wide variety of pressurized products. An aerosol valve (not shown) is located in known fashion at the top of the aerosol container in a mounting cup attached to the container, with the aerosol valve stem extending upwardly in known fashion for actuation by aerosol valve actuator 10. Valve actuator 10 can be snapped on to the aerosol container itself and/or over the rim of the mounting cup, again all as well known.

Figure 6:
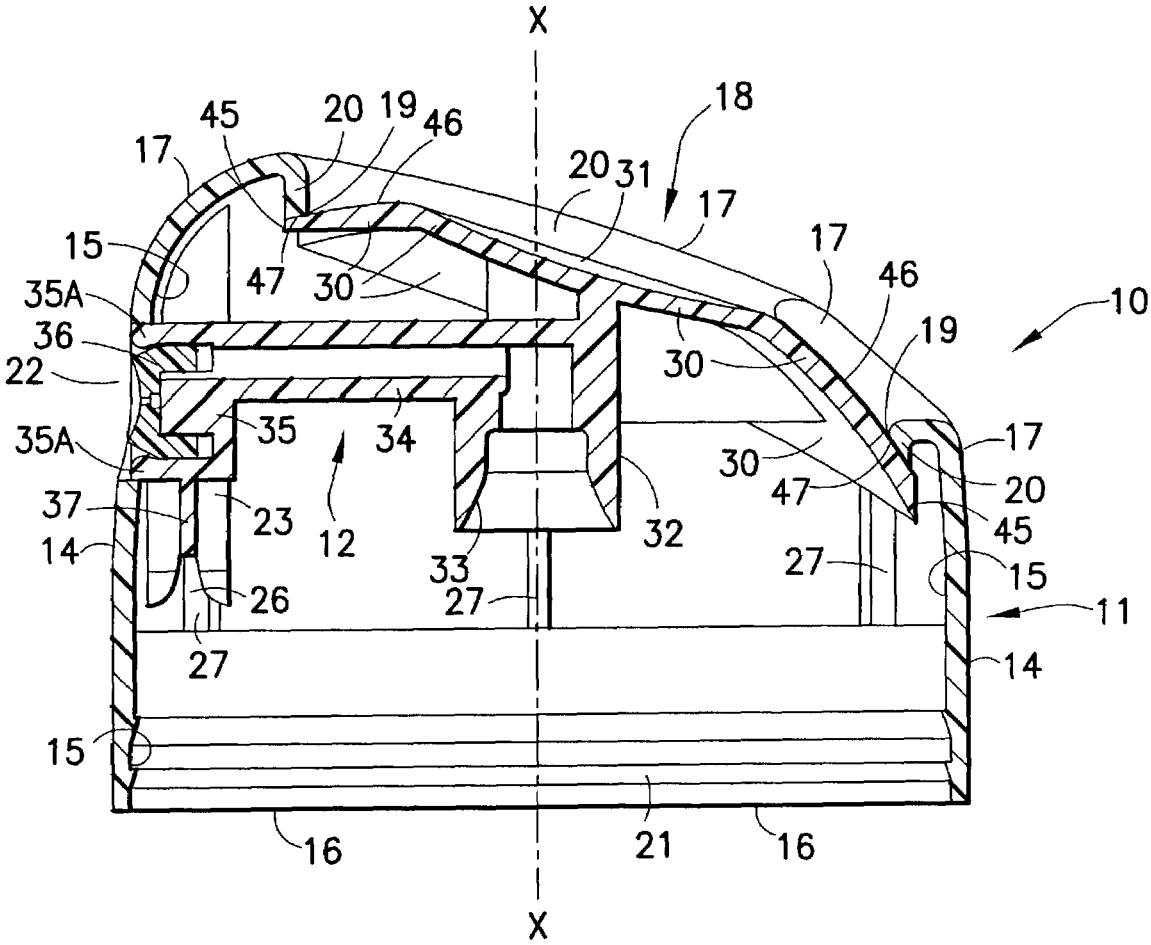
FIG. 6 is an axial cross-sectional view of the assembled gapless aerosol valve actuator of the present invention.
Figure 7:
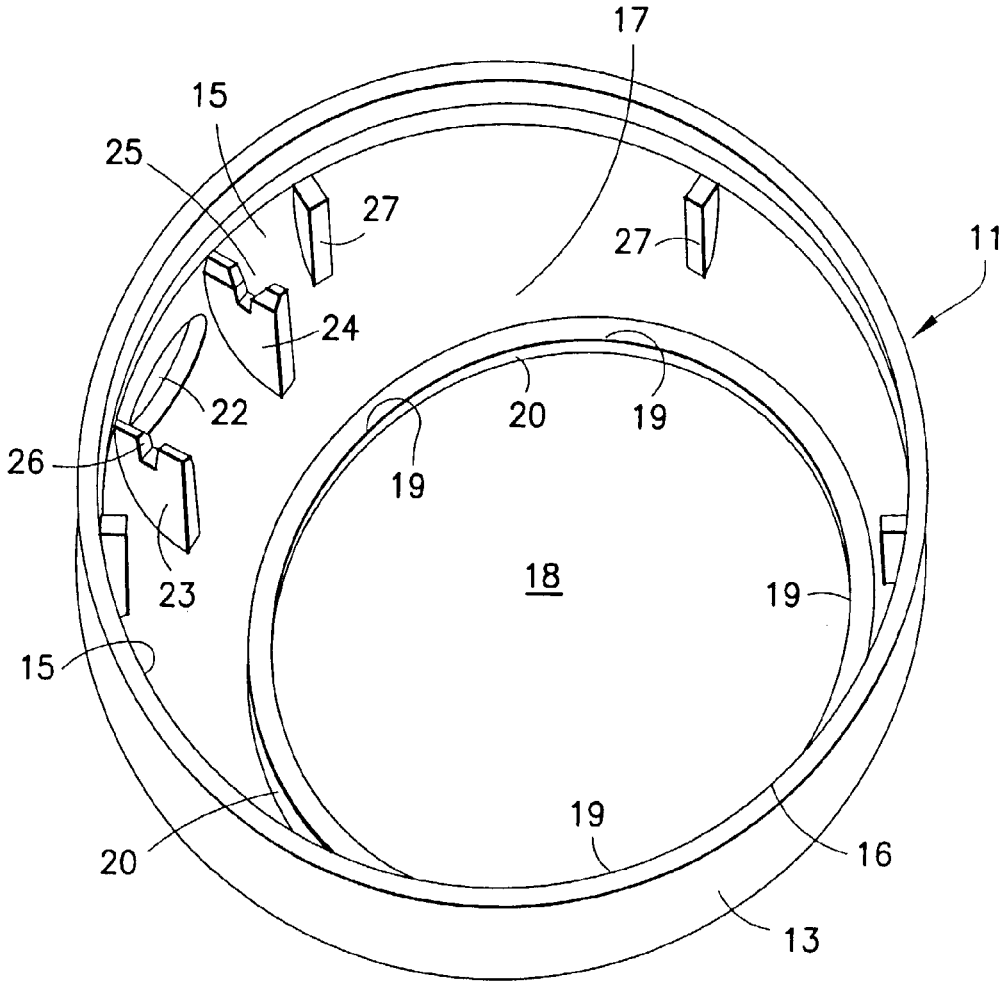
FIG. 7 is a bottom perspective view of the shell-like enclosure member of the gapless aerosol valve actuator of the present invention prior to assembly; and, FIG. 8 is a bottom perspective view of the actuating member of the gapless aerosol valve actuator of the present invention prior to assembly.

Member 11 of the aerosol valve actuator 10 is a shell-like enclosure, in particular shown separately in FIG. 7 in upside-down perspective and shown assembled in cross-section in FIG. 6. Actuating member 12 of actuator 10 is in particular shown separately in FIG. 8 and shown assembled in cross-section in FIG. 6. The manner of assembly of shell-like enclosure member 11 and actuating member 12 is described in further detail hereinafter.

Shell-like member 11 has side wall 13 with exterior and interior wall surfaces 14 and 15, an open bottom 16 for mounting to an aerosol container, and upper portion 17 having opening 18 therein which has a perimeter 19. Opening 18 may have a downwardly extending flange 20 extending about all or a portion of the opening, or may lack such a flange. The flange 20 may also extend considerably deeper down into upper portion 17 and/or at a substantial angle, if desired for aesthetic reasons. Member 11 may have either a continuous horizontal rib or separate discrete horizontal ribs 21 extending inwardly of interior wall surface 15 adjacent open bottom 16 to snap onto the aerosol container and/or over the rim of the mounting cup of the aerosol valve. Side wall 13 has an opening 22 therein for product dispensing as hereinafter described. Side wall 13 further may have brackets 23 and 24 with slots 25 and 26, the brackets extending from interior wall surface 15 adjacent opening 22, for the purpose of assembling actuating member 12. Circumferentially spaced vertical ribs 27 extending inwardly of interior wall surface 15 also may be provided to lend strength and support to the shell-like enclosure member 11.

Figure 5:
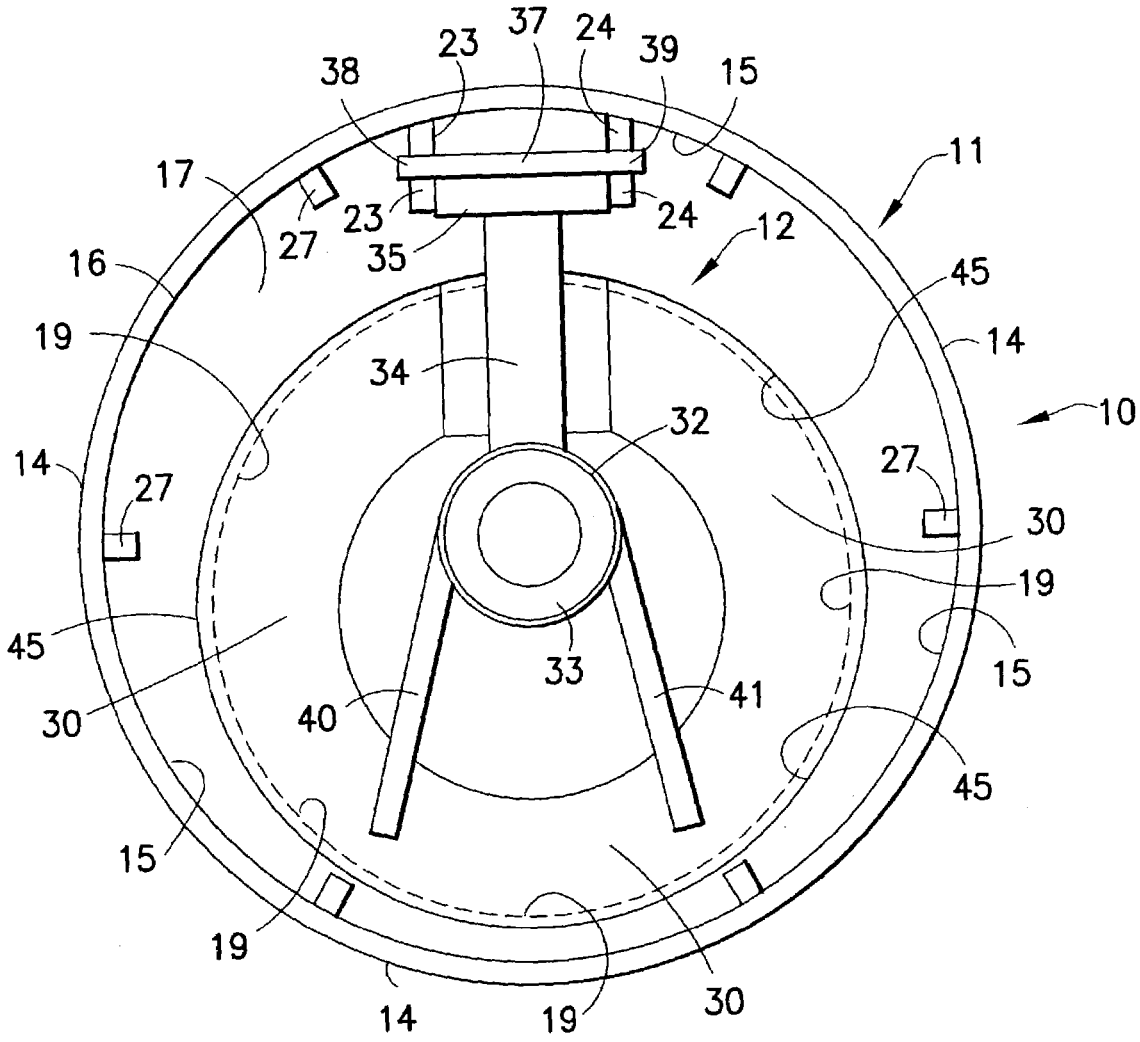
FIG. 5 is a bottom plan view of the assembled gapless aerosol valve actuator of the present invention.
Figure 8:
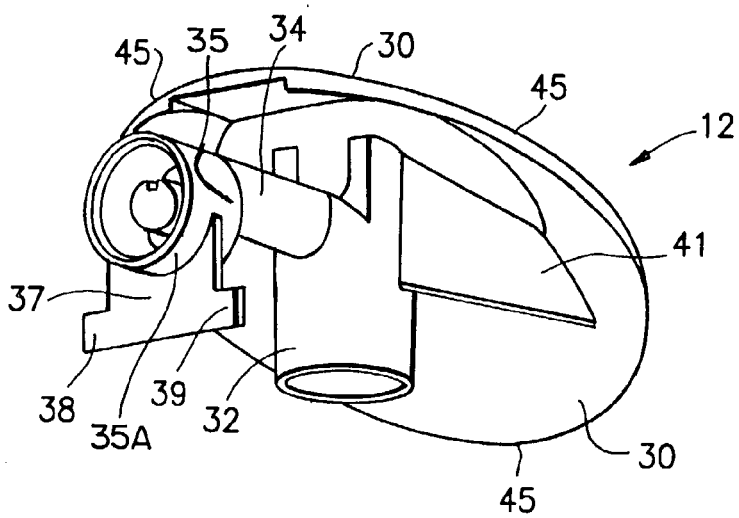

Referring in particular to FIGS. 5, 6, and 8, actuating member 12 of aerosol valve actuator 10 includes finger actuating pad 30 (having a central top surface depression 31' if desired), product tube 32 depending from the bottom of the finger pad 30 and having a lower flared socket 33 for engaging the usual aerosol valve stem (not shown), and outlet tube 34 molded into actuating member 12 in fluid connection with depending product tube 32. Outlet tube 34 terminates in outlet nozzle 35 within which may be inserted a conventional nozzle insert 36. Depending below outlet nozzle 35 is bracket 37 having lower bracket side extensions 38 and 39 (see FIG. 8). Finger pad supporting ribs 40 and 41 also depend from finger pad 30 and extend rearwardly from product tube 32. Actuating member 12 may be of a contrasting color to enclosure member 11.

When aerosol valve actuator 10 is assembled, actuating member 12 is inserted into the open bottom 16 of shell-like enclosure 11, and bracket extensions 38 and 39 are snap or friction fit into slots 25 and 26 of brackets 23 and 24 of member 11 (see FIGS. 5 and 6). Outlet nozzle 35 has a front circular end 35A forward of depending bracket 37. Circular end 35A may be dimensioned to snap fit and extend within, and substantially abut the side wall of, circular product dispensing opening 22 in the side wall of enclosure 11 (see FIG. 6), which prevents spray noise from circular end 35*a* having an adjacent path back inside shell-like enclosure 11 to create undesirable resonant intensification of the spray noise by the enclosure 11. Still further, it is assured that this assembly is retained during transportation of the actuators to a customer, feeding of the actuators to the aerosol containers with aerosol valves by the customers, and assembly of the actuators onto the aerosol containers.

In the assembled condition of actuator 10, finger actuator pad 30 by virtue of its dimensioning and mounting is biased up against the underside of upper portion 17 of shell-like enclosure member 11. Flange 20 may or may not be present as part of upper portion 17. When finger pad 30 is actuated by the user, product tube 32 is pushed downwardly against the aerosol valve stem, aided by outlet tube 34 flexing adjacent outlet nozzle 35. Product in the aerosol container will then flow up tube 32, out tube 34, through the nozzle, and through the exit hole 22 in the enclosure member 11. When the actuating finger 30 is released, the finger pad 30 is biased back to its non-actuated upper position of FIG. 6.

Finger pad 30 is sized to have an outer surrounding perimeter 45 which is greater than the surrounding perimeter 19 of opening 18 in upper portion 17 of enclosure member 11 (see FIGS. 5,6). Finger pad 30 extends, in its non-actuated position, completely across opening 18, and has an upper surface 46 including portion 47 thereof directly adjacent perimeter 45 which underlies and contacts the upper portion 17 of member 11 directly adjacent its opening 18. This contact, in the described embodiment, will be against the bottom of flange 20 that fully encircles opening 18 (see FIG. 6). If it is desired to eliminate flange 20 for design reasons, the contact will be further upward against the underside of upper portion 17 adjacent the perimeter 19 of opening 18. In either event, it will be seen that there will be no visible gap between opening perimeter 19 in member 11 and the immediately adjacent, radially inward (toward the vertical axis x-x of actuator 10), upper surface 46 of finger pad 30.

In addition to eliminating the visually less-than-aesthetic aforedescribed gap, the structural dimensioning described above provides that finger pad 30 cannot be pushed up through opening 18 when the assembled actuator 10 is first mounted on the aerosol valve stem. The disadvantageous "smiling" effect is thereby eliminated.

Figure 4:
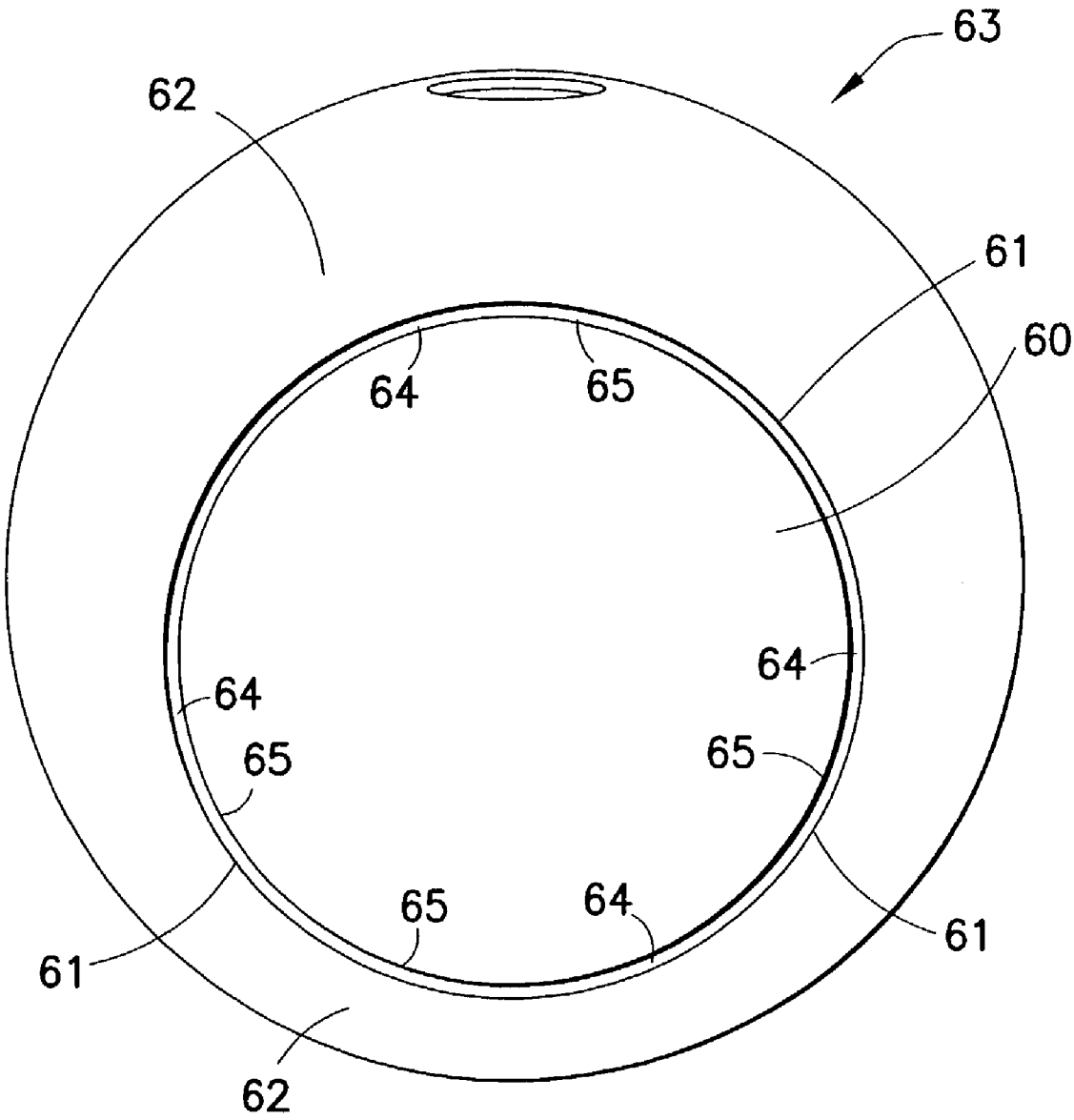
FIG.4 PRIOR ART
FIG. 4 is a top plan view of a generic prior art assembled aerosol valve actuator.

Now referring to FIG. 4, a generalized prior art actuator showing is indicated which is a top plan view corresponding to FIG. 3 for ease of description and comparison. In FIG. 4, actuating finger pad or button 60 is positioned within opening 61 in the upper portion 62 of the shell-like enclosure of an aerosol actuator 63. Here, however, as contrasted with FIG. 3, a gap 64 extends about the perimeter 65 of the finger pad or button 60. (It should again be noted that reference numeral 20 in FIG. 3 refers not to any gap but rather to a flange of the shell-like enclosure). Gap 64 in the prior art of FIG. 4 is considered unattractive to aerosol product marketers and to consumers, and may also allow for finger pad or button 60 to be pushed in part above the top of the actuator 63 when the actuator is assembled to the valve stem, thereby creating the "smiling" effect. The generalized actuator of FIG. 4 may include any of the three types referenced above in the "Background Of The Invention."

The several features of the present invention described above together define a unique, simple and strong aerosol actuator which is easily manufactured and assembled, is aesthetically pleasing, does not create excessive spray noise, and which functions reliably and efficiently for the consumer.

It will be appreciated by persons skilled in the art that variations and/or modifications may be made to the present invention without departing from the spirit and scope of the invention. The present embodiment is, therefore, to be considered as illustrative and not restrictive. It should also be understood that positional terms as used in the specification are used and intended in relation to the normal positioning shown in the assembly and cross-sectional drawings, are not otherwise intended to be restrictive.

What is claimed is:

1. An aerosol valve actuator comprising a first shell-like member and a second actuating member, said two members being discrete and distinct from one another; said first shell-like member having a side wall with exterior and interior wall surfaces, an open bottom for mounting to an aerosol container, and an upper portion with an opening therein having a perimeter; said second actuating member being bottom mounted into and connected to said first member and having a finger actuating pad biased to an upper position against said upper portion when not actuated, a depending tube from the finger actuating pad for connection to an aerosol valve stem, and an outlet tube in fluid connection with the depending tube and terminating in an outlet nozzle; said finger actuating pad in its non-actuated position having a perimeter extending radially beyond the perimeter of the opening in the upper portion of the first member; such that said finger actuating pad has an upper surface which, when the finger pad is in its non-actuated position, underlies and contacts the upper portion of said first member directly adjacent the opening therein, thereby leaving no discernable gap between the perimeter of the opening in the first member upper portion and the finger pad upper surface, and preventing the finger actuating pad being pushed through said opening upon assembly of the actuator onto the aerosol valve stem.

2. The aerosol valve actuator of claim 1, wherein said second member is connected to the interior wall surface of said first member by a snap-fit connection.

3. The aerosol valve actuator of claim 1, wherein said first member sidewall has a product dispensing opening directly adjacent said outlet nozzle, and said outlet nozzle has an outer end snap-fit and extending into said product dispensing opening upon assembly of said first and second members.

4. The aerosol valve actuator of claim 3, wherein said interior wall surface of said first member has brackets extending therefrom, said brackets containing slots, and said outlet nozzle of said second member has a depending bracket with side extensions that fit into said slots upon assembly of said first and second members, said outlet nozzle outer end extending forward of said depending bracket and dimensioned to snap fit and extend into said sidewall product dispensing opening, thereby reducing spray noise of the actuator.

5. The aerosol valve actuator of claim 1, wherein said first discrete member is of a contrasting color from that of said second discrete member.

* * * * *